United States Patent [19]

Cobbs

[11] 4,191,492

[45] Mar. 4, 1980

[54] METHOD OF INSTALLING A LINER IN A LARGE DIAMETER BOREHOLE

[76] Inventor: James H. Cobbs, 5144 S. New Haven, Tulsa, Okla. 74135

[21] Appl. No.: 947,011

[22] Filed: Sep. 29, 1978

Related U.S. Application Data

[62] Division of Ser. No. 838,745, Oct. 3, 1977.

[51] Int. Cl.[2] ..... E21D 11/04; E21D 5/00; E21D 9/00

[52] U.S. Cl. ..... 405/133; 166/289

[58] Field of Search ..... 405/133, 233, 236, 248, 405/227, 269, 243; 166/289

[56] References Cited

U.S. PATENT DOCUMENTS

| | | | |
|---|---|---|---|
| 2,734,343 | 2/1956 | Asketh | 405/133 |
| 3,216,200 | 11/1965 | Scisson et al. | 405/133 X |
| 4,070,869 | 1/1978 | Williams | 405/227 |

FOREIGN PATENT DOCUMENTS

| | | | |
|---|---|---|---|
| 187954 | 10/1907 | Fed. Rep. of Germany | 405/133 |
| 265861 | 2/1927 | United Kingdom | 405/236 |

*Primary Examiner*—Alexander Grosz
*Attorney, Agent, or Firm*—Head & Johnson

[57] ABSTRACT

A means of anchoring a lining of low flexural rigidity with grout into a borehole drilled in the earth, which comprises a relatively thin-walled cylinder which may be composed of steel, elastomeric or plastic material of selected diameter, which is less than that of the borehole. A plurality of keys, each having one end bouded to the wall of the cylinder, extend outwardly, and have an enlarged head portion which is adapted to be bonded to the grout, which will fill the annular space between the cylinder and the borehole. A plurality of vertically spaced support rings surround the cylinder and are attached to the cylinder by means of a plurality of keys. The support rings are supported and spaced apart by means of circumferentially spaced rods, which are attached at their ends to the support rings and are guided at intermediate positions by keys which are locked to the cylinder.

3 Claims, 8 Drawing Figures

METHOD OF INSTALLING A LINER IN A LARGE DIAMETER BOREHOLE

This is a division of application Ser. No. 838,745, filed Oct. 3, 1977.

BACKGROUND OF THE INVENTION

1. Field of the Invention

This invention lies in the field of linings for large diameter boreholes drilled into the earth.

More particularly, this invention lies in the field of linings for large diameter boreholes, which are made of materials of low flexural rigidity and have means for locking to the grouting which ties them to the wall of the borehole.

2. Description of the Prior Art

Drilled shafts or boreholes in the earth are used for a wide variety of purposes, including entries into mines, points of entry for mine storage facilities and for the storage of biological waste and for other purposes.

The most common linings for drilled boreholes or shafts in the earth are rigid steel casings, which are grouted into place by filling the annulus between the borehole wall and the steel casing with a Portland cement grout. The cost of rigid steel casing is high, especially in cases where large diameters are involved and large hydrostatic pressures are anticipated. The steel casings have great weight, which necessitates the use of specialized equipment, capable of handling very large weights, to run the casing into the shaft or borehole.

Another disadvantage of grouted-in-place rigid steel casing is that of transporting the casing to the borehole, because of its size and weight.

Still another disadvantage of the rigid steel casing is the time involved in placing it into the shaft prior to grouting, because of the requirement that many joints must be welded together and the welds allowed to cool, before the casing can be further lowered into the hole. This is a stepwise operation, where one joint of casing is welded to a preceding joint, the weld is allowed to cool and then the casing is lowered by the length of the new joint prior to welding still another joint, etc.

A thin lightweight lining material offers many advantages in that the lining can in some application be an essentially continuous membrane, which will have a relatively low weight and can be delivered to the site in a collapsed condition. It may be delivered in one continuous length or in a few pieces of substantial length, requiring fewer joints to provide the full depth of liner.

Though the concept appears ideal, heretofore there has been no means of maintaining the correct internal diameter of membrane linings of low flexural rigidity while grouting in place or when subjected to external pressure.

This invention describes a new technique for using a combination of a membrane liner of low flexural rigidity with Portland cement grout to create a rigid waterproof lining which is impervious to the movement of the fluid, either into or out of the borehole, or shaft, and in which the membrane is rigidly joined to the grout and can withstand relatively high differential pressures by virtue of the reinforcement created by the enclosing cement grout.

SUMMARY OF THE INVENTION

It is a primary object of this invention to provide a lining for a large diameter shaft or borehole in the earth by providing a thin-walled cylinder of suitable diameter, which is reinforced by means of rings surrounding the membrane and support rods supporting the rings and including also a large plurality of keys which are attached to the wall of the low flexural rigidity cylinder and are immersed in the grout and locked to it by means of appropriately shaped heads.

These and other objects are realized and the limitations of the prior art are overcome in this invention by providing a thin-walled cylinder of suitable diameter, which is less than that of the borehole so that when the cylinder is inserted into the borehole, there will be an annular space of selected radial width, which will be filled with Portland cement grout to bond the cylinder to the wall of the borehole.

A first plurality of keys of selected material are attached to the wall of the cylinder and extend outwardly and carry a suitable head, which permits bonding the liner cylinder to the cement grout which fills the annular space.

For the larger diameters of liners a preferred construction utilizes a plurality of axially-spaced support rings which surround the liner cylinder and are in the annular space between the cylinder and the wall. These support rings are of suitable material and are designed to be substantially rigid. They are attached to the cylindrical wall by means of radial keys and serve to stiffen the cylinder and provide a more perfect cylindrical contour.

The support rings are spaced apart by selected distance and are held in these spacings by means of a plurality of circumferentially spaced vertical support rods, which are attached to support rings at their ends. This serves to stiffen the cylinder in vertical and circumferential directions.

In addition, suitable keys are attached to the cylinder and extend out into the annular space, where with suitably shaped heads they are imedded into the grout and tie the liner to the grout.

Another set of keys may be utilized which are attached to the cylinder and are also attached to the vertical support rods so as to provide a more rigid construction of the cylinder.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
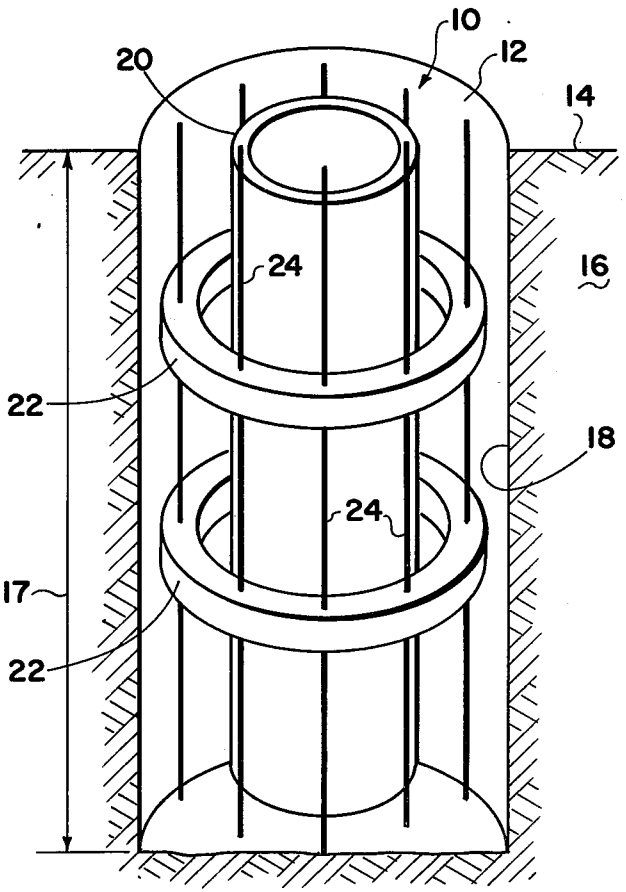
FIG. 1 illustrates schematically one embodiment of this invention inserted into an open borehole in the earth.

Referring now to the drawings and in particular to FIG. 1, there is shown schematically one embodiment of the invention. The numeral 10 indicates generally the system comprising a cylinder 20 of low flexural rigidity material of suitable wall thickness and diameter, positioned axially inside of a borehole 18 in the earth 16 extending from the surface 14 down to a depth 17. There is an annular space 12 between the cylinder 20 and the wall 18 of the borehole. In this annular space are provided a plurality of support rings 22, which are spaced axially and are maintained in their positions by means of a plurality of circumferentially spaced support rods 24. The support rings and support rods are attached to the cylinder 20 by means of a plurality of keys which will be fully described in connection with FIGS. 4, 5, 6 and 7.

Figure 2:
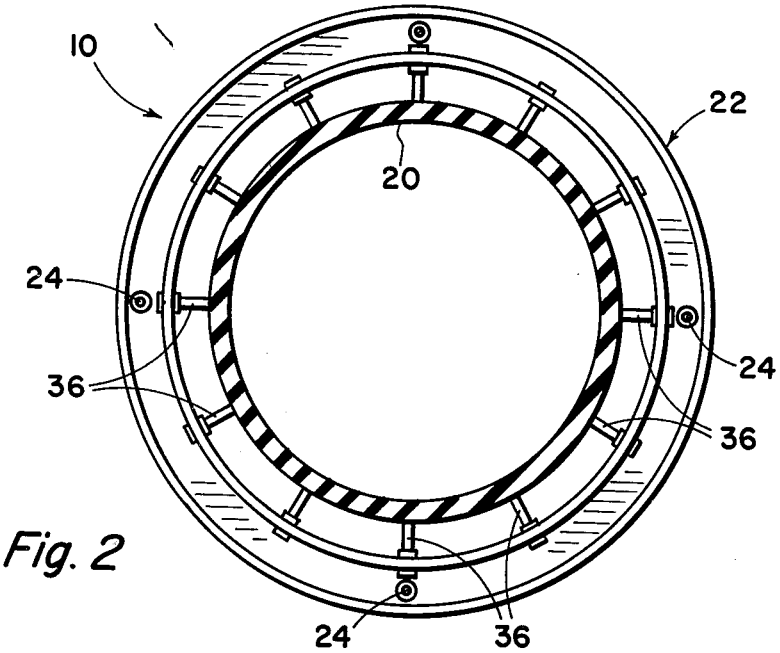
FIGS. 2 and 3 illustrate in plan and elevation sections the detailed construction of one embodiment of this invention.
Figure 3:
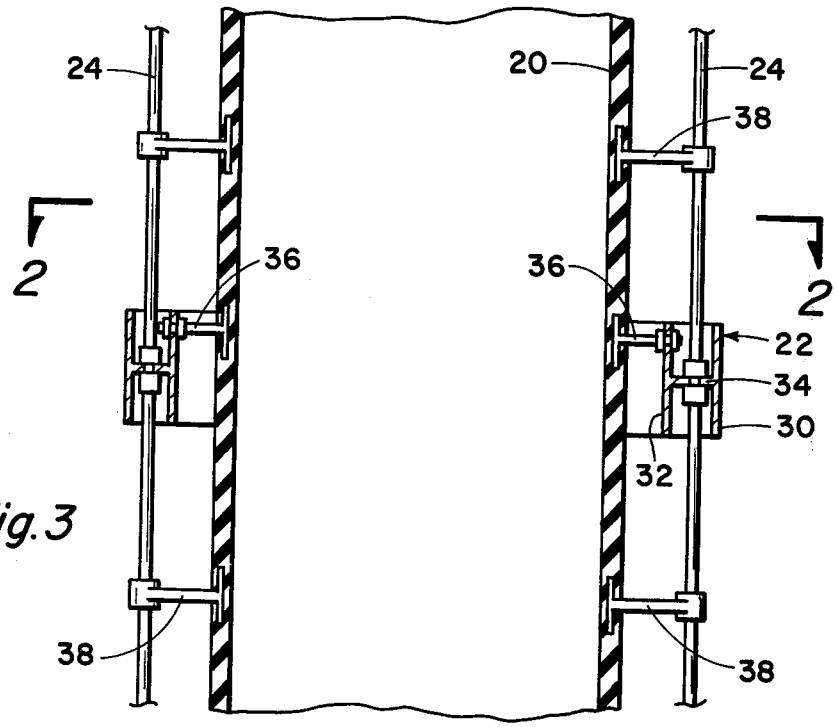

Referring now to FIGS. 2 and 3, there is shown in horizontal and vertical cross-section one embodiment of the invention. There is a thin-walled cylinder 20 of suitable low flexural rigidity material. There are a plurality of support rings indicated generally by the numeral 22, which may be of any selected cross-sectional shape, such as the H cross-section illustrated, having outer walls 30, inner walls 32, and a horizontal web 34. These support rings are of suitable diameter so as to be spaced outwardly from the cylinder 20. They are held in this position by a plurality of radial keys 36 which are locked at their inner end to the cylinder and are attached to the support rings by any suitable means, such as the threaded ends interlocking with the support rings illustrated.

A plurality of circumferentially spaced support rods 24 are utilized to connect between adjacent support rings, and to be attached to the support rings, so that the entire liner, including the cylinder, support rings, and support rods, form a fairly rigid elongated structure, by means of which the liner can be lifted and lowered into the borehole.

Another type of key 38 is provided which is locked at its inner end into the wall of the cylinder and is attached to the support rods at its outer end, such as by having an opening or eye through which the rods are passed so as to maintain the position of the rods at intermediate points between the support rings, so as to make the cylinder more rigid.

Figure 4:
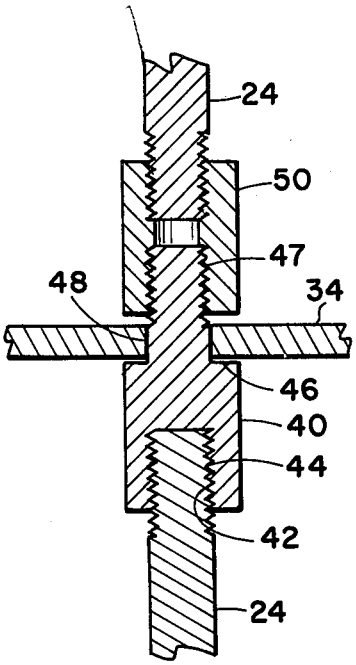
FIGS. 4, 5, 6 and 7 illustrate details of the various types of keys which are imbedded at one end into the cylinder and serve to tie the cylinder to the grout, to outer support rings and to support rods.
Figure 6:
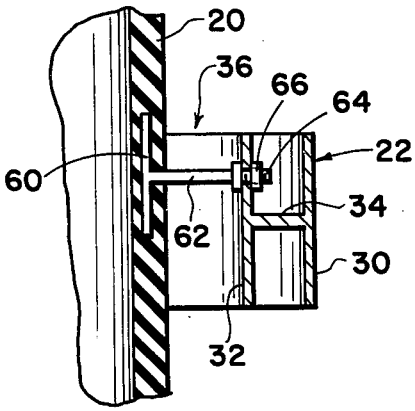

Referring now to FIGS. 4 and 6, details are shown of the construction of the support rings and the manner in which they are attached to the wall of the cylinder 20. In FIG. 6 the H cross-section of the ring is shown in greater detail than in FIG. 3 and its attachment by means of the keys 36 which have an inner end 60 imbedded into the wall of the cylinder shanks 62 which are threaded at the end 64 and are locked to the ring by means of nuts 66, for example.

The support rings can be of any desired cross-sectional shape and size, and can be attached in any way to the wall of the cylinder 20. There is no limitation on the details of such shape, size or manner of attachment.

Illustrated in FIG. 4 is a detail of the construction and assembly of the support rods 24 to the web 34 of the support rings, illustrated in FIGS. 3 and 6. The rods 24 are threaded at top and bottom ends. At the top end is a fixture 40 which has an internal thread 44 on the bottom, which mates with the threaded end 42, of the rods 24. This fixture has a shoulder 46 and a threaded end 47 which is locked to the web 34 by means of a collar 50 which screws down on the threaded end 47 and locks the web. The upper end of the collar 50 has a threaded opening which is adapted to receive the bottom threaded end of another support rod 24 etc. Of course, other means may be provided for attachments of the support rods to the support rings.

Figure 5:
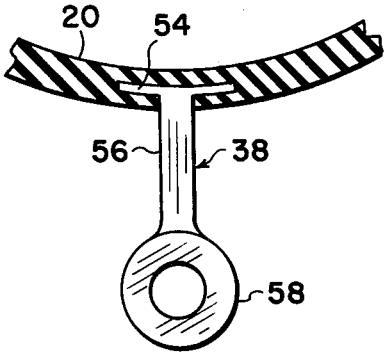

In FIG. 5 is illustrated one type of key indicated generally by the numeral 38 which has an inner end 54 by means of which it can be imbedded in, or attached to, the cylinder 20. It has a spacing shank 56 and an eye 58 adapted to pass a support rod 24 and to hold it in proper spaced relation to the cylinder 20.

Figure 7:
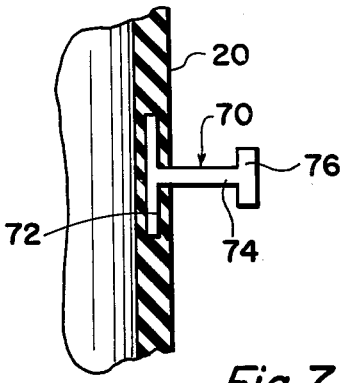

FIG. 7 illustrates another key 70 which can be attached 72 to the cylinder 20 and which has a shank 74 of selected length, terminating in a head 76 spaced a selected distance. If desired, the shank 74 or head 76 may have a weak section designed in so that the head will shear or break off at a selected applied force.

When the cylinder is being assembled with the support rods, support rings and keys and is lowered into the borehole the support rings, keys, supported rods, etc. are all imbedded in the Portland cement grout that fills the annular space and serves to strongly and rigidly tie the cylinder to the grout and make a watertight, rigid, thick-walled cylindrical liner for the borehole.

Three different types of keys have been illustrated, one which is just to provide a bond between the cylinder and the grout, such as illustrated in FIG. 7, another type 36 which is utilized to tie the support ring to the cylinder, as illustrated in FIG. 6, and a third type 38 in FIG. 5, which is used to tie the support rods to the cylinder at intermediate points between the support rings. However, the assembly can be made with one or more of these devices and not necessarily with all of them. For example, if the diameter of the borehole is small and if the ratio of the thickness to the diameter is not too small, the cylinder will have sufficient rigidity that it may not be necessary to provide the support rings and support rods. In that case, keys of the type shown in FIG. 7 would be utilized for the purpose of anchoring the cylinder wall to the grout and that would be all that would be necessary. On the other hand, if the diameter of the hole is large and it is impractical to provide a great enough thickness to make the cylinder self supporting then the addition of the support rings and support rods would be advisable, etc.

Various materials can be used for the cylinder. For example, if the material is castable, such as plastic, then the keys illustrated in FIGS. 4, 5, 6 and 7 can be inserted into the wall and be cast integral with it. On the other hand, the cylinder may be made of a suitable material that can be extruded and the keys can be then attached to the extruded cylinder provided suitable means are utilized to make the bond strong enough between the key and the cylinder.

Another way of constructing the cylinder and the key would be to make the cylinder of suitable thermoplastic material and, similarly, to mold or extrude the keys of the same type of material. The keys can be attached to the cylinder by thermal fusion, as is used in the joining of sections of large diameter pipes made of thermoplastic materials. Such a process would involve means to heat a selected area of the outer wall of the cylinder and to heat the surface of the key until they were both at a suitable elevated temperature and then to press the two heated surfaces together, so that they will bond and form a monolithic structure.

Another way of constructing the keys which are used to bond the cylinder to the grout and illustrated in FIG. 7 would be to use a short section of a thermoplastic thin-walled pipe to form a thin strap or loop, which is attached to the outside wall of the thermoplastic liner by the heat fusion method, etc.

Figure 8:
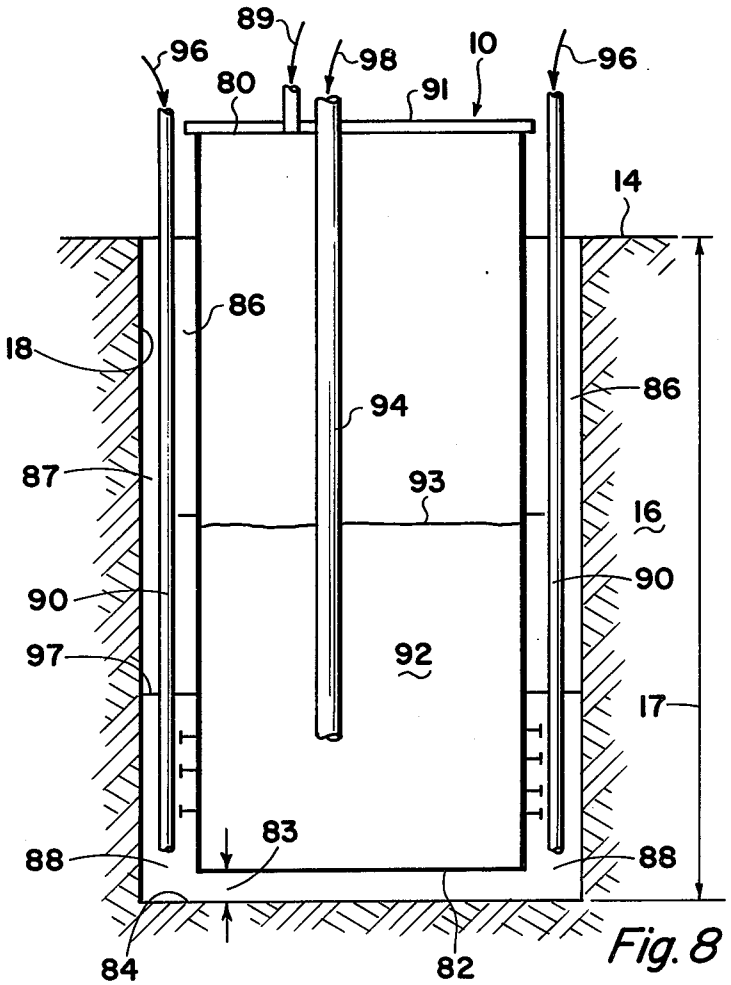
FIG. 8 illustrates schematically one method of installing the embodiment of FIGS. 2 and 3.

Having constructed the assembly as indicated in FIGS. 1, 2 and 3, in accordance with the details of FIGS. 4, 5, 6 and 7, it becomes necessary to install this assembled liner into a borehole and to grout it into position. This is indicated in FIG. 8, which shows in cross-section, a borehole having a wall 18 of suitable diameter in the earth 16, drilled from the surface 14 down to a bottom 84 at a depth 17. The liner is schematically indicated by numeral 10 without all of the detail of FIG. 1. This is lowered into position in the borehole with the bottom end 82 at a selected distance 83 above the bottom 84 of the borehole. The liner 10 is centered in the hole, providing an annular space 86 of uniform radial width.

Assume that this hole has been drilled by the use of drilling mud and is filled with drilling mud at the time the liner is to be inserted. The liner is dropped into the mud-filled hole to the proper depth. A plurality of grout line 90 of suitable diameter are positioned in the annulus in circumferentially-spaced relation, with the bottom ends close to the bottom 84 of the hole. Portland cement grout is pumped from the surface in accordance with arrows 96 and the grout, because of its greater density, displaces the mud upwardly. The level of the grout is indicated 97 in FIG. 8. As the grout rises and pushes upwardly the mud in the annulus 86, the grout pipes 90 can be raised. However, their bottom ends must be maintained below the interface 97 between the grout 85 in the space 88 and the mud 87 in the annulus on top of the grout. The interior space 92 inside the cylinder 10 is also filled with mud. As grout is pumped in and the grout lines are withdrawn the annulus will be filled with grout. Because of the greater density of the grout, than the mud inside the space 92, in the inside of the cylinder it may be advisable to close off the top of the cylinder by means of a closure 91 and to apply pressure through the closure to the surface of the mud inside the cylinder. The added pressure is required to prevent the collapse of the cylinder inwardly because of the greater hydrostatic force of the cement grout.

In other cases the hole may be drilled by mining or other means and is dry. In that case the liner is positioned as before. The grout lines 90 are installed. Also, a mud line 94 is provided so that mud can be inserted into the inside of the cylinder in accordance with arrows 98, then, as the grout fills the bottom end 88 of the annular space 86 and rises with a surface such as 97, the hydrostatic force inwardly of the mud on the cylinder can be compensated by mud in the space 92 having a longer column from the top 93 than the column of grout, such as to balance the hydrostatic force inwardly of the cement. As the cement grout is applied and the top surface 97 moves upwardly, likewise, the level 97 of the mud is increased as necessary. As in the previous description, when the cement grout reaches the top surface, it may be necessary to fill the entire internal space of the liner with mud and to apply a suitable pressure to the top in accordance with arrow 89.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. With a liner of low flexural rigidity adapted to be grouted into a borehole in the earth, said liner comprising a cylinder having a plurality of spaced outwardly extending keys attachcd at their first ends to said cylinder and extending outwardly, with their outer ends having suitable means to lock to the grout, the method of installation into a mud filled borehole comprising the steps of:

(a) installing at least one support ring around said cylinder at a selected position, concentric with said cylinder and attached to said cylinder by a plurality of circumferentially spaced keys;

(b) inserting said liner, axially, into said borehole, with its bottom end at a selected distance above the bottom of said borehole;

(c) inserting a plurality of grout pipes circumferentially spaced into the annulus between said cylinder and the wall of said borehole to a point near the bottom of said borehole;

(d) pumping in grout through said pipes into said annulus, while (e) raising said pipes, as the level of the grout in said annulus rises, always keeping the bottom ends of said pipes below the surface of said grout.

2. The method as in claim 1 including the step of closing the top of said cylinder and applying a selected fluid pressure to the top of the mud column inside said cylinder.

3. The method as in claim 1 including the additional step, prior to step (b) and after step (a) of;

(f) installing a plurality of support rings around said cylinder, each supported by and positioned between adjacent support rings by a plurality of circumferentially spaced support rods.

* * * * *